US009359925B2

(12) United States Patent
Bailey, III et al.

(10) Patent No.: US 9,359,925 B2
(45) Date of Patent: Jun. 7, 2016

(54) OIL SEPARATOR IN A POSITIVE CRANKCASE VENTILATION SYSTEM OF AN ENGINE

(71) Applicant: Ford Global Technologies, LLC, Dearborn, MI (US)

(72) Inventors: Claude Weston Bailey, III, Warren, MI (US); Kevin Joseph Kochanski, Oxford, MI (US); Christopher William Newman, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/257,904

(22) Filed: Apr. 21, 2014

(65) Prior Publication Data

US 2015/0300223 A1 Oct. 22, 2015

(51) Int. Cl.
*F02B 25/06* (2006.01)
*F01M 13/04* (2006.01)

(52) U.S. Cl.
CPC ..... *F01M 13/04* (2013.01); *F01M 2013/0461* (2013.01)

(58) Field of Classification Search
CPC ..... F01M 13/04; F01M 13/0416; F01M 2013/0488; F01M 13/0011; F01M 2013/0027; F01M 2013/0044; F01M 13/0033; F01M 35/10222
USPC ..... 123/573, 41.86, 572
See application file for complete search history.

(56) References Cited

U.S. PATENT DOCUMENTS

| | | | | |
|---|---|---|---|---|
| 4,401,093 | A | 8/1983 | Gates, Jr. et al. | |
| 6,290,738 | B1 * | 9/2001 | Holm | 55/309 |
| 7,678,169 | B1 * | 3/2010 | Gwin et al. | 55/385.4 |
| 8,347,865 | B2 | 1/2013 | Valencia et al. | |
| 8,495,993 | B2 | 7/2013 | Rice et al. | |
| 8,511,291 | B2 | 8/2013 | Hirano et al. | |
| 8,555,827 | B2 | 10/2013 | Schleiden | |
| 2010/0307466 | A1 | 12/2010 | Ruppel et al. | |
| 2013/0087128 | A1 | 4/2013 | Valencia et al. | |

OTHER PUBLICATIONS

Anonymous, "Method to Adsorb Crankcase Blow-by Gas Hydrocarbons into Evap Canister during Engine Non-Combusting Modes," IPCOM No. 000238215D, Published Aug. 8, 2014, 2 pages.

* cited by examiner

*Primary Examiner* — Hung Q Nguyen
*Assistant Examiner* — Omar Morales
(74) *Attorney, Agent, or Firm* — Greg Brown; Alleman Hall McCoy Russell & Tuttle LLP

(57) ABSTRACT

An oil separator in a positive crankcase ventilation (PCV) system is described herein. The oil separator includes an oil separation conduit in fluidic communication with an intake conduit and an oil reservoir and an entry conduit including an entry conduit orifice arranged at an angle of between 80 and 100 degrees with regard to the oil separation conduit, the entry conduit orifice opening into the separation conduit at a point between the separation conduit outlet and the separation conduit inlet.

18 Claims, 4 Drawing Sheets

OIL SEPARATOR IN A POSITIVE CRANKCASE VENTILATION SYSTEM OF AN ENGINE

FIELD

The present disclosure relates to an oil separator in a positive crankcase ventilation system of an engine and a method for operating the positive crankcase ventilation system.

BACKGROUND AND SUMMARY

During engine operation small amounts of combustion gases may leak past piston rings into the crankcase during combustion operation. These gases are commonly referred to as blow-by gases. Blow-by gases may significantly contribute to engine emissions when left unmitigated. Therefore, positive crankcase ventilation (PCV) systems have been developed to decrease blow-by gas emissions, thereby reducing vehicle emissions. The PCV systems are typically configured to draw air from the crankcase into the intake system, and subsequently the cylinders, thereby creating a closed loop for the blow-by gases. As a result, blow-by gas emissions are reduced, thereby reducing the engine's environmental impact. However, the blow-by gases may also contain oil droplets or vapor which may degrade combustion operation when flowed into the cylinders from the PCV system. When oil droplets are flowed into the cylinders from the intake system, engine emissions are increased and engine power output is decreased. Therefore, oil separators have been developed to remove oil from the blow-by gases flowed into the intake system from a PCV outlet.

U.S. Pat. No. 8,495,993 discloses an oil separator mechanism positioned between a first and second cylinder blocks in a valley. The oil separator mechanism includes a baffle defining the boundary between a contaminated air chamber and a clean air chamber. The baffle is configured to separate oil from the gases flowing through the separator. The Inventors have recognized several drawbacks with the oil separator disclosed in U.S. Pat. No. 8,495,993. For example, the baffle disclosed in U.S. Pat. No. 8,495,993 has a large surface area, thereby decreasing the compactness of the oil separator and more generally the PCV system. Moreover, the geometry of the baffle and an inlet conduit of the separator also increase losses within the PCV system. As a result, a higher vacuum is needed in the intake system to draw the blow-by gas from the crankcase, limiting the periods of PCV operation. Consequently, engine emissions are increased.

As such in one approach, an oil separator in a positive crankcase ventilation (PCV) system is provided. The oil separator includes an oil separation conduit in fluidic communication with an intake conduit and an oil reservoir and an entry conduit including an entry conduit orifice arranged at an angle of between 80 and 100 degrees with regard to the oil separation conduit, the entry conduit orifice opening into the separation conduit at a point between the separation conduit outlet and the separation conduit inlet.

When the conduits in the oil separator are arranged in this way, oil droplets in the crankcase gases flowing therethrough contact a wall of the oil separation conduit to substantially reduce the likelihood (e.g., inhibits) of oil droplets flowing downstream into an exit port of the oil separator. Oil is therefore collected in the oil separation conduit. It will be appreciated that arranging of the oil separation conduit and entry conduit in this way increases the amount of oil which may be separated from the crankcase gas when compared to prior oil separators. Additionally, the arrangement of the oil separation conduit and the entry conduit in this way enables oil to be removed from crankcase gases flowing threrethrough via a compact device. As a result, compactness of the PCV system may be increased, if desired, while enabling a greater amount of oil to be removed from the crankcase gases. Moreover, the losses in the oil separator are also decreased, due to the configuration of the oil separation conduit and entry conduit, when compared to previous oil separators.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

BRIEF DESCRIPTION OF THE DRAWINGS

FIGS. 2 and 3 are drawn approximately to scale, however other relative dimensions may be used, if desired.

DETAILED DESCRIPTION

An oil separator with an entry conduit arranged at an angle between 80 and 100 degrees with regard to an oil separation conduit is described herein. When the conduits in the oil separator are arranged in this way, oil droplets in the crankcase gases flowing therethrough contact a wall of the oil separation conduit and enables a reduction in the likelihood of (e.g., substantially inhibits) oil flowing downstream into an exit port of the oil separator. Thus, the oil separation conduit facilitates the collection of oil in the separator. The collected oil may then be allowed to drain into an oil reservoir during selected operating conditions. In this way, oil is removed from the crankcase gases via a compact device. Moreover, the arrangement of the conduits in the oil separator enables oil to be efficiently removed from the gases without substantially decreasing losses in the PCV system, enabling the oil separator to function over a wider range of engine conditions when compared to previous oil separator having greater flow losses.

Figure 1:
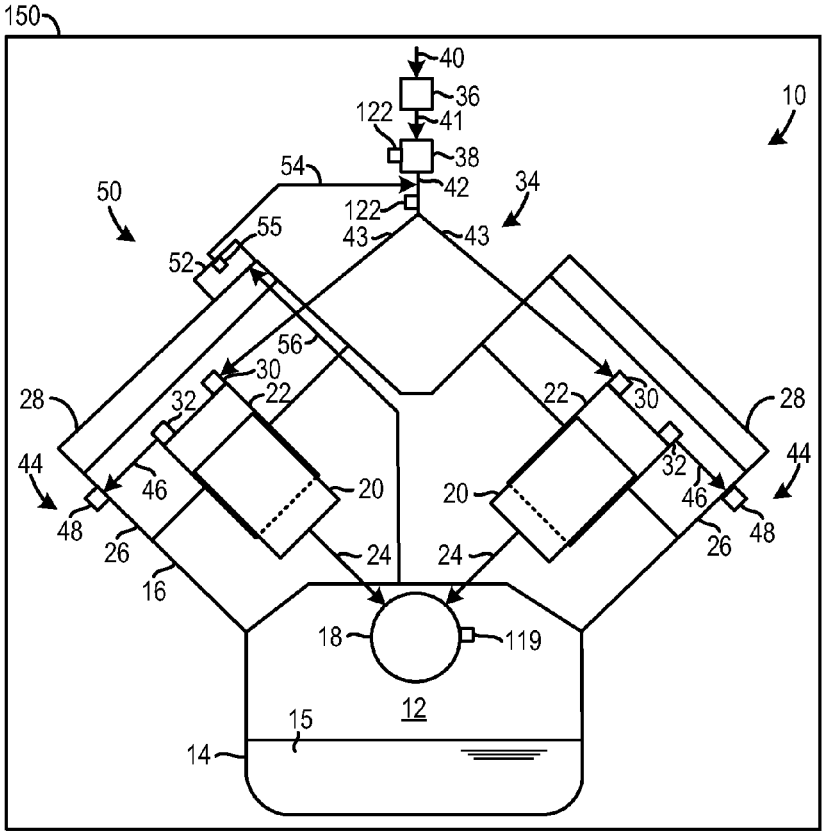
FIG. 1 shows a schematic depiction of an engine including a positive crankcase ventilation (PCV) system.
Figure 1:
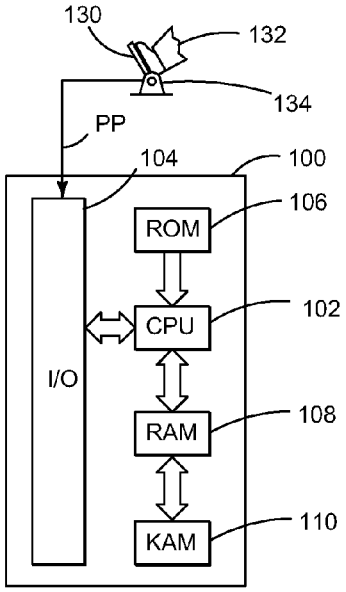

FIG. 1 shows a schematic depiction of an engine 10. The engine 10 may be included in a vehicle 150. Thus, the engine 10 provides motive power to the vehicle 150. Additionally, the engine 10 includes a crankcase 12. The boundaries of the crankcase 12 may be formed by an oil reservoir 14 and an engine block 16. The oil reservoir 14 configured to store oil 15 or suitable lubricants. It will be appreciated that the oil reservoir 14 may be included in an engine lubrication system configured to provide lubricant to engine components. It will be appreciated that the crankcase 12 may be substantially sealed from the surrounding environment, in one example. That is to say the gases in the crankcase do not substantially flow out of the crankcase at undesirable locations into the surrounding environment. Additionally, a PCV system 50 may be provided in the engine 10 to manage crankcase gases in the engine. The PCV system 50 is configured to provide a closed loop for the gases in the engine, to reduce blow-by gas emissions, in one example.

A crankshaft 18 is included in and enclosed by the crankcase 12. The crankshaft is coupled to pistons 20 positioned in cylinders 22 of the engine 10. Each cylinder is arranged in a different cylinder bank. In some examples, each cylinder bank may include one or more cylinders. Moreover, the cylinders are arranged in a V-configuration. Thus, the central axes of the cylinders are arranged at non-straight angles. However, alternate cylinder configurations have been contemplated. For instance, the cylinders may be arranged in a straight line, a horizontally opposed configuration, etc.

Arrows 24 denote the coupling of the cylinders to the crankshaft. It will be appreciated that piston rods or other suitable coupling mechanisms may be utilized to provide the mechanical coupling between the pistons and the cylinders 22. The cylinders are formed by the connection of the engine bock 16 and cylinder heads 26. Cam covers 28 may also be coupled to the cylinder heads 26. The cam cover 28 may at least partially enclose cam shafts and other engine components.

Intake valves 30 and exhaust valves 32 are coupled to each of the cylinders 22. In the depicted example, each cylinder includes one intake valve and one exhaust valve. However, engines with multiple intake valves and/or exhaust valves per cylinder have been contemplated.

The intake valves 30 are included in an intake system 34 configured to provide intake air to the cylinders 22. The intake system 34 may further include a filter 36, a throttle 38, intake passages denoted via arrows (40, 41, 42, and 43), etc. Additional intake system components could include an intake manifold and a compressor. It will be appreciated that in some examples, the intake passages 43 may be coupled to downstream intake manifolds or may be intake manifolds themselves. Additionally, a portion of each of the intake passages 43 extend through a corresponding cylinder heads 26. The intake system 34 may include additional components in some examples, such as additional throttles, passages, compressors, etc.

Likewise, the exhaust valves 32 are included in an exhaust system 44 configured to receive combustion gases from the cylinders 22. The exhaust system 44 further includes exhaust passages, denoted via arrows 46, extending through the cylinder heads 26 and exhaust manifold 48. The exhaust system 44 may further include emission control devices (e.g., filters, catalysts, etc.,) mufflers, exhaust passages, turbines, etc.

In one example, during engine operation, a cylinder piston gradually moves downward from TDC, bottoming out at BDC by the end of the power stroke. The piston then returns to the top, at TDC, by the end of the exhaust stroke. The piston then again moves back down, towards BDC, during the intake stroke, returning to its original top position at TDC by the end of the compression stroke. During cylinder combustion, an exhaust valve may be opened just as the piston bottoms out at the end of the power stroke. The exhaust valve may then close as the piston completes the exhaust stroke, remaining open at least until a subsequent intake stroke has commenced. In the same way, an intake valve may be opened at or before the start of an intake stroke, and may remain open at least until a subsequent compression stroke has commenced. It will be appreciated that the above combustion cycles is exemplary and other types of combustion cycles in the engine have been contemplated. In this way, combustion energy generated in the cylinders may be transferred to the crankshaft to provide a rotational power output.

During combustion operation blow-by gases may flow past the pistons 20 and into the crankcase 12. It will be appreciated that the blow-by gases may include oil vapor, combustion gases, air, etc. The PCV system 50 is provided in the engine to manage the blow-by gases. The PCV system 50 includes an oil separator 52 configured to remove oil from crankcase gases flowing therethrough, described in greater detail herein. Additionally, the PCV system 50 includes an outlet passage 54 in fluidic communication with the oil separator 52 and the intake passage 42. Thus, the outlet passage 54 opens into intake passage 42. A PCV valve 55 is integrated into the oil separator 52, in the depicted example. Specifically, the PCV valve may be integrated into an exit port of the oil separator. However, other PCV valve positions have been contemplated. For instance, the PCV valve may be positioned downstream of the oil separator 52 and upstream of the intake passage 42. The PCV valve 55 is configured to adjust the amount of crankcase gases flowing therethrough. In one example, the PCV valve 55 may be passively operated. However, in other examples the PCV valve 55 may be actively operated via a controller 100. Therefore, in one example the PCV valve 55 may substantially inhibit gas flow during a first operating condition and permit gas flow during a second operating condition. It will be appreciated that the second operating condition may be when a vacuum is present in the intake passage 42 and/or the engine is performing combustion operation. As shown, the intake passage 42 is positioned downstream of the throttle 38. In this way, crankcase gases may be draw into the intake system via a vacuum. The PCV system 50 further includes an inlet passage denoted via arrow 56. Therefore, it will be appreciated that crankcase gases may flow from the crankcase 12 into the inlet passage 56 and subsequently flow through the oil separator 52 and the outlet passage 54 and into the intake passage 42. In this way, blow-by gases may be directed into the intake system to reduce engine emissions.

The controller 100 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 100 may receive various signals from sensors coupled to engine 10, in addition to those signals previously discussed, including measurement of engine speed from sensor 119, throttle position (TP) from a throttle position sensor 120; and an intake passage pressure from sensor 122. Sensor 122 may be used to provide an indication of vacuum, or pressure, in the intake passage. Note that various combinations of the above sensors may be used. It will be appreciated that the controller 100 may also be configured to send control signal to various engine components such as the throttle 38.

Figure 2:
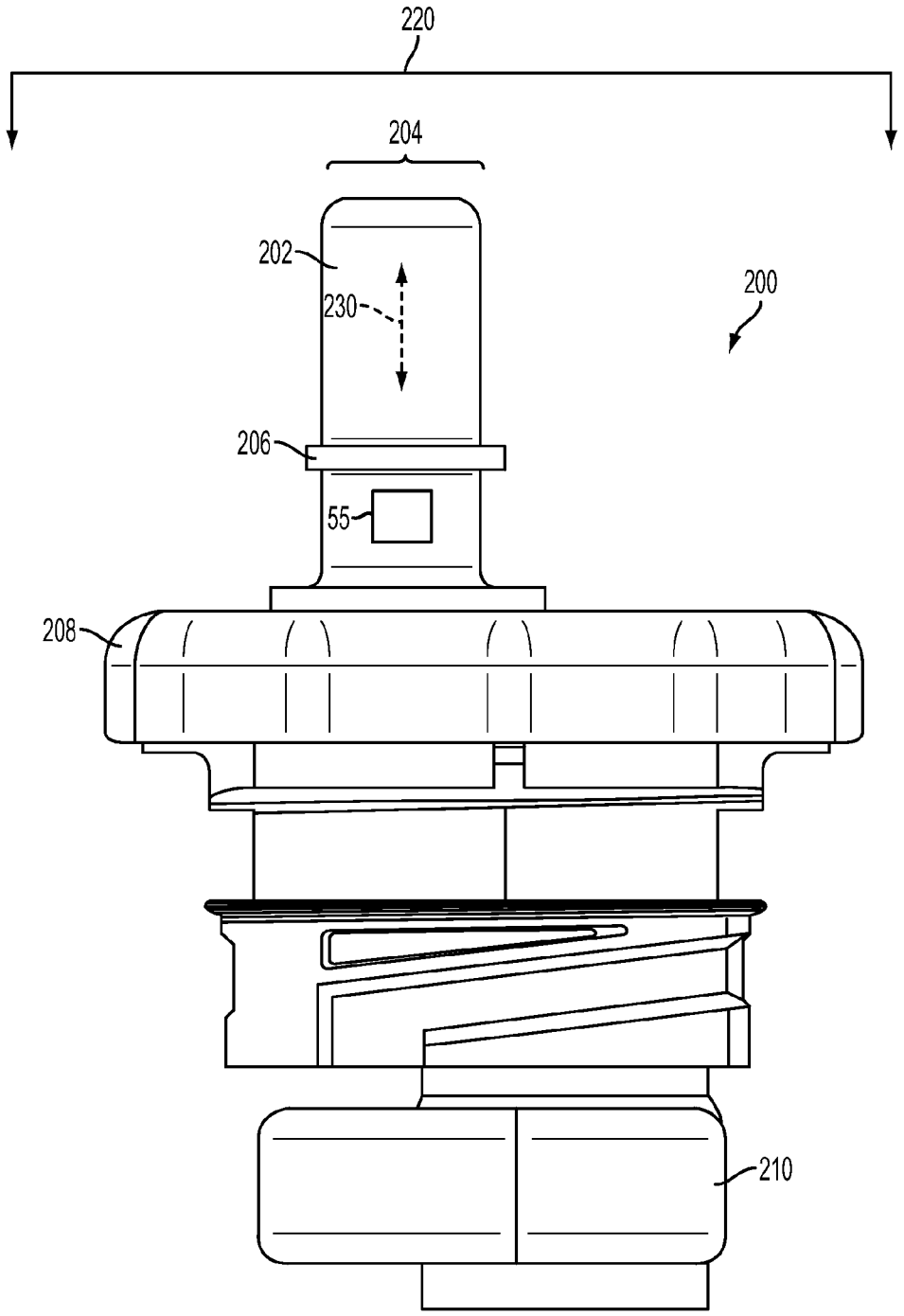
FIG. 2 shows an illustration of an example oil separator.

FIG. 2 shows an illustration of an example oil separator 200. It will be appreciated that the oil separator 200 shown in FIG. 2 may be the oil separator 52 shown in FIG. 1, in one example. Thus, the oil separator 200 may be included in the PCV system 50 shown in FIG. 1. As illustrated, the oil separator 200 includes an exit port 202. The exit port 202 may be coupled to the outlet passage 54 shown in FIG. 1, in one example. Therefore, the exit port 202 may be in fluidic communication with an intake conduit downstream of a throttle. Furthermore, the exit port 202 includes an exit port outlet 204 and PCV Valve 55. The PCV valve 55 is generically depicted via a box. However, it will be appreciated that the PCV valve 55 may a suitable valve such as check valve and may span an interior region of the exit port. Additionally, the exit port includes a lip 206, enabling the oil separator to be quickly coupled to downstream components. Furthermore, a central axis 230 of the exit port 202 is vertically aligned. However, other exit port and more generally oil separator orientations have been contemplated. For instance, the exit port 202 may extend in a vertical direction and/or may be parallel to an oil separation conduit 304, shown in FIG. 3. Continuing with FIG. 2, the exit port 202 has a cylindrical geometry, in the depicted example. However, other exit port geometries have been contemplated.

The oil separator 200 further includes a first housing section 208 and a second housing section 210. The first housing section 208 may be removably coupled to the second housing section 210. In one example, the first housing section 208 may be an oil fill cap and the second housing section 210 may be an oil fill tube. It will be appreciated the oil cap may be removably coupled to the oil fill tube to enable a vehicle operator to refill the oil in the engine. The first housing section 208 (e.g., oil cap) may be removably coupled to the second housing section 210 (e.g., oil fill tube) to enable a vehicle operator to refill the oil in the engine. It will be appreciated that the oil fill tube may be in fluidic communication with an oil reservoir such as the oil reservoir 14 shown in FIG. 1. In this way, the oil separator is integrated into an oil cap, thereby increasing the compactness of the PCV system while providing a dual use functionality of the oil cap. As a result, the compactness of the engine (e.g., engine 10 shown in FIG. 1) in which the oil separator is positioned is increased. Cutting plane 220 defines the cross-section of the oil separator 200, shown in FIG. 3.

Figure 3:
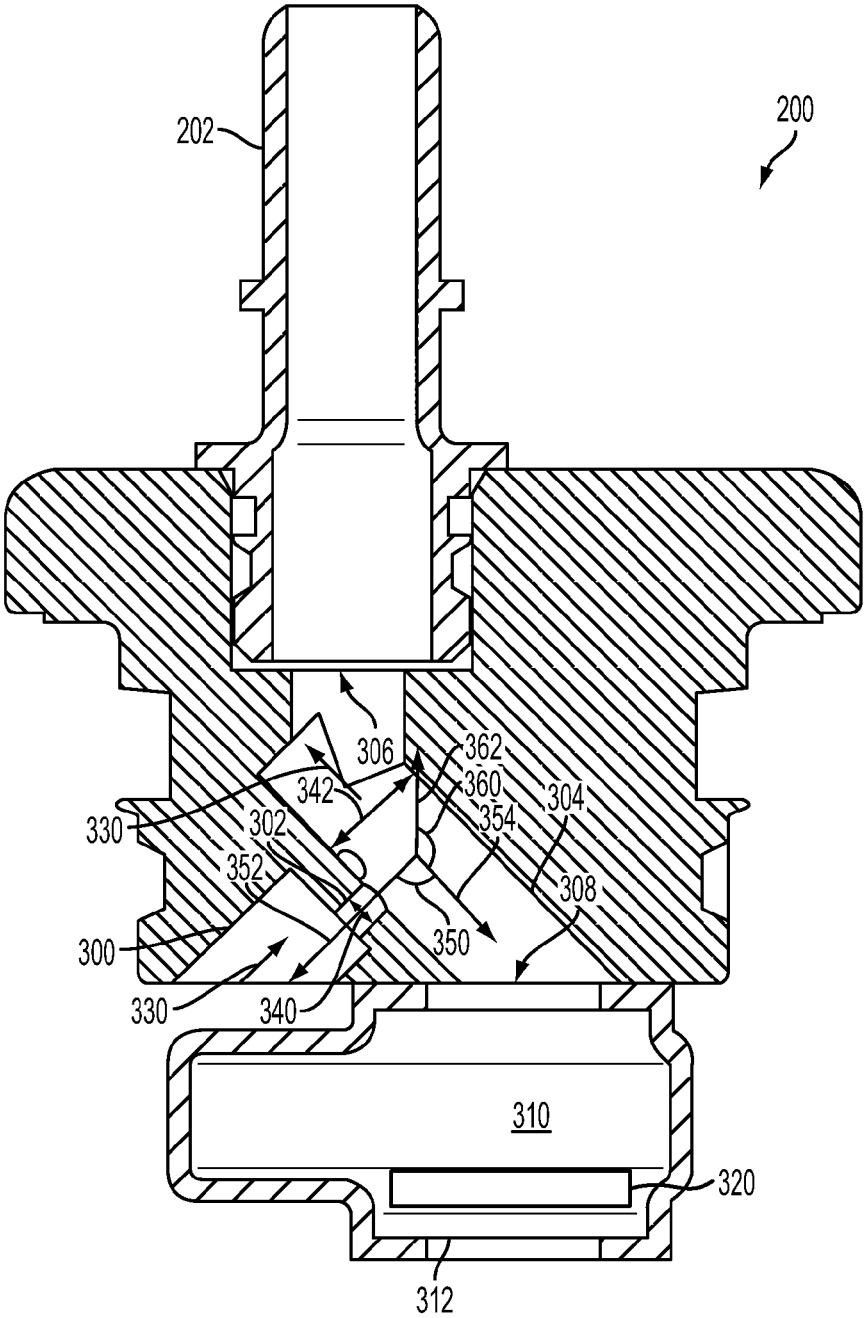
FIG. 3 shows a cross-sectional view of the oil separator shown in FIG. 2.

FIG. 3 shows a cross-sectional view of the oil separator 200 shown in FIG. 2. An entry conduit 300 is included in the oil separator 200. The entry conduit 300 may be coupled to an inlet passage, such as inlet passage 56 shown in FIG. 1. Thus, the entry conduit 300 is in fluidic communication with an oil reservoir, such as the oil reservoir 14, shown in FIG. 1. The entry conduit 300 includes an entry conduit orifice 302 opening into an oil separation conduit 304. Specifically, the entry conduit orifice 302 opens into the oil separation conduit 304 at a point between a separation conduit outlet 306 and a separation conduit inlet 308. Thus, the entry conduit 300 may be coupled to (e.g., directly coupled to) the oil separation conduit 304. It will be appreciated that direct coupling denotes that there are no intervening components positioned between the coupled components. Although a single orifice 302 is depicted, it will be appreciated that the entry conduit 300 may include a plurality of orifices. Specifically, in one example the entry conduit 300 may include 3 orifices. In such an example, the orifices may have a substantially identical size and/or geometry. Specifically, the orifices may have a cylindrical geometry and have similar inner diameters and/or may be parallel to one another. However in other examples, the size and/or geometry may vary between the orifices. Additionally, the orifice 302 is smaller in diameter than an upstream section of the entry conduit 300. As shown the upstream portion is also cylindrical in diameter. Additionally, the orifice 302 is offset from the upstream portion in the depicted example. However, in other examples the central axes of the upstream portion and the orifice may be aligned.

In one example, the entry conduit 300 is arranged at an angle 350 with regard to the oil separation conduit 304. Further in one example, at least a portion of the separation conduit 304 is positioned vertically above the entry conduit 300. As shown the angle 350 is measured between a central axis 352 of the entry conduit orifice 302 and a central axis 354 of the oil separation conduit 304. In one example, the angle 350 may be between 80 and 100 degrees. In another example, the angle 350 may be between 85 and 95 degrees or between 88 and 92 degrees. Specifically, in the depicted example the angle 350 is 90 degrees. However, other similar angle values or ranges may be used if desired. When the entry conduit and oil separation conduit are arranged in this way, oil droplets may contact an interior side-wall of the oil separation conduit opposing the outlet of the orifice 302. It will be appreciated that the oil droplets are substantially inhibited from following the angled turn into the exit port 202, due to the angled arrangement of the conduits. Consequently, the oil droplets collect in the oil separator and flow downward into an oil drain chamber 310. It will be appreciated that the oil may wet the walls of the oil separation conduit which may be conducive to oil separation. Furthermore, the arrangement of the entry conduit and oil separation conduit in this way decreases losses in the oil separator when compared to previous oil separators which include a larger number of bends, expansions, contractions, and/or other features that increase losses. As a result, oil vapor may be separated from the crankcase gases in a compact and efficient manner.

More specifically, the particular range of the angle of the conduits described in the particular example of FIGS. 2-3 has been recognized by the inventors herein to be particularly highly correlated to and effective at achieving the results noted. Further, the particular range of the angle in combination with other geometric features shown in FIGS. 2-3 achieve a particular synergy in the ability to better control overall oil separation and related performance of the device. In some examples, therefore, it may be the combination of the particular angle range and the relative angle of other components in relation thereto that together produce improved performance.

In this regard, it will be appreciated that the geometry and size of the entry conduit 300 and the oil separation conduit 304 may be selected to further aid in removal of oil from the crankcase gases. Specifically, the entry conduit and/or orifice may be sized and/or shaped (such as shown in FIGS. 2-3) to increase the velocity of the gases above a threshold value when entering the separation conduit 304 to enable the gases to flow into an interior surface of the separation conduit at a desired speed. For instance, the entry conduit 300 and/or inner diameter 340 of orifice 302 may be configured to increase the flow velocity of the gases above 20 meter/second (m/s), in one example. Additionally, an inner diameter 340 of the orifice 302 is shown in FIG. 3. The inner diameter 340 may be 3 millimeters (mm), in one example. Additionally, an inner diameter 342 of the oil separation conduit 304, is also shown. The inner diameter 342 may be 5 mm, in one example. A ratio between the inner diameter of the entry conduit and the inner diameter of the separation conduit may be 3/5, or in the range of between 2/5 and 4/5. However, other similar ratios have been contemplated and may be use if desired. In addition, this particular ratio range, in combination with the range of the angle of the conduits described herein may work in tandem to achieve overall better performance than either features in isolation of the other.

Further in one example, a cross-sectional area of the oil separation conduit 304 may be greater than a cross-sectional area of the entry conduit orifice 302. The cross-sectional area may be measured across a plane perpendicular to a general flow direction or central axes of the conduits, indicated via arrows 330.

Additionally, the oil separation conduit 304 and the entry conduit 300 are shown to have a cylindrical geometry. However, other conduit geometries have been contemplated. For instance, the entry conduit may have a conical shape. Further in one example, a cross-section area of the entry conduit may decrease in a downstream direction. Specifically in one example, the cross-sectional area of the entry conduit may decrease at a non-constant rate. However in other examples, the cross-sectional area of the entry conduit may decrease at a constant rate.

Furthermore, the oil separation conduit 304 is arranged at an angle 360 with regard to a vertical axis 362. In the depicted example, the angle 360 is 135°. However, in other examples the angle 360 may be between 110 and 160 degrees. Thus, the oil separation conduit 304 may at least partially extend in a vertical direction.

The separation conduit outlet 306 is coupled to (e.g., directly coupled to) the exit port 202. Additionally, the separation conduit inlet 308 is coupled to (e.g., directly coupled to) the oil drain chamber 310. The oil drain chamber 310 may be coupled to an oil fill tube 312 in fluidic communication with an oil reservoir, such as oil reservoir 14, shown in FIG. 1. It will be appreciated that the oil drain chamber 310 may include a valve 320, generically depicted via a box, configured to open when a pressure in the vacuum source (i.e., intake passage 42 shown in FIG. 1) drops to 0. In one example, the valve 320 may be an elastomeric diaphragm. However, other types of valves have been contemplated, such as a check valve. In this way, collected oil may be flowed back to the oil reservoir at desired time intervals. Continuing with FIG. 3, the oil drain chamber 310 has a larger volume than the oil separation conduit 304. The exit port 202 is also shown in FIG. 3. As previously discussed, the exit port 202 is in fluidic communication with an intake conduit.

Figure 4:
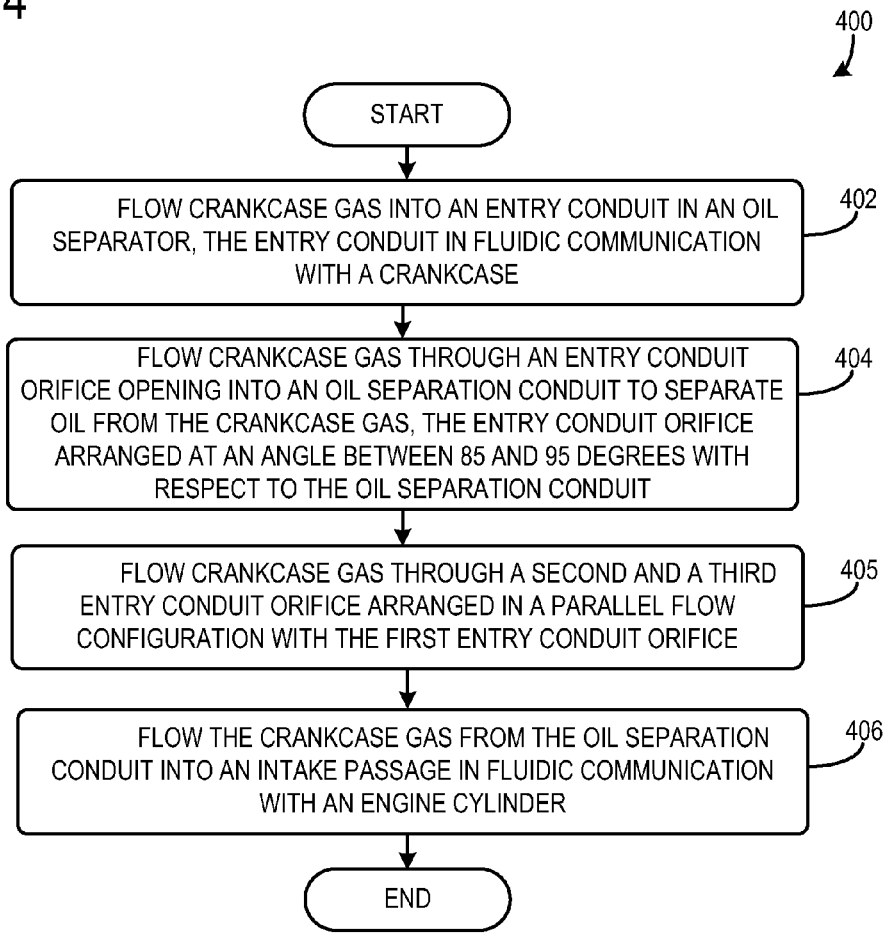
FIG. 4 shows a method for operation of a PCV system.

FIG. 4 shows a method 400 for operation of a PCV system. It will be appreciated that method 400 may be implemented by the PCV system and oil separator discussed above with regard to FIGS. 1-3 or may be implemented by another suitable PCV system and oil separator.

At 402 the method includes flowing crankcase gas into an entry conduit in an oil separator, the entry conduit in fluidic communication with a crankcase. Next at 404 the method includes flowing crankcase gas through an entry conduit orifice opening into an oil separation conduit to separate oil from the crankcase gas, the entry conduit orifice arranged at an angle between 85 and 95 degrees with respect to the oil separation conduit.

At 405 the method may include flowing crankcase gas through a second and a third entry conduit orifice arranged in a parallel flow configuration with the first entry conduit orifice. However, in other examples step 405 may be omitted from the method 400. Next at 406 the method includes flowing the crankcase gas from the oil separation conduit into an intake passage in fluidic communication with an engine cylinder. In this way, the oil separator extracts oil from the crankcase gases in a compact and efficient manner.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the examples described herein, but is provided for ease of illustration and description. One or more of the illustrated actions, operations and/or functions may be repeatedly performed depending on the particular strategy being used.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An oil separator in a positive crankcase ventilation (PCV) system, comprising: an oil separation conduit in fluidic communication with an intake conduit and an oil reservoir; and an entry conduit and an orifice thereof each having a central axis angled between 80 and 100 degrees from a central axis of the oil separation conduit, the orifice opening into the oil separation conduit between a gas outlet and another outlet for separated oil of the oil separation conduit; where a central axis of an exit port of the oil separator extends in a vertical direction, and where the central axis of the oil separator conduit is angled between 110 and 160 degrees from the vertical direction.

2. The oil separator of claim 1, where a cross-sectional area of the oil separation conduit is greater than a cross-sectional area of the orifice, and wherein a cross-sectional area of the entry conduit is greater than the cross-sectional area of the orifice.

3. The oil separator of claim 2, where the cross-sectional area of the oil separation conduit is 5 millimeters (mm).

4. The oil separator of claim 1, where a cross-sectional area of the entry conduit decreases in a downstream direction.

5. The oil separator of claim 4, where the cross-sectional area of the entry conduit decreases at a non-constant rate in the downstream direction.

6. The oil separator of claim 1, where the entry conduit central axis is angled 90 degrees from the oil separation conduit central axis.

7. The oil separator of claim 1, where the oil separation conduit and the entry conduit are cylindrical.

8. The oil separator of claim 1, where the entry conduit includes second and third entry conduit orifices opening into the oil separation conduit.

9. The oil separator of claim 8, where the entry conduit orifices are identical in size and geometry.

10. The oil separator of claim 1, further comprising an oil drain chamber coupled to the another outlet for separated oil, the oil drain chamber having a larger volume than the oil separation conduit, the oil drain chamber in fluidic communication with an oil reservoir.

11. The oil separator of claim 1, where the oil separation conduit and the entry conduit are included in an oil fill cap removably coupled to an oil drain chamber coupled to an oil fill tube.

12. A method for removing oil from a gas flow in a positive crankcase ventilation system comprising:

flowing crankcase gas into an entry conduit in an oil separator, the entry conduit in fluidic communication with a crankcase;

flowing crankcase gas through an entry conduit orifice opening into an oil separation conduit to separate oil from the crankcase gas, the entry conduit and entry conduit orifice each having a central axis angled between 85 and 95 degrees from a central axis of the oil separation conduit, and the oil separation conduit having a central axis angled between 110 and 160 degrees from a vertical axis; and flowing the crankcase gas from the oil separation conduit into an intake passage in fluidic communication with an engine cylinder.

13. The method of claim 12, further comprising flowing crankcase gas through second and third entry conduit orifices arranged in a parallel flow configuration with the first entry conduit orifice.

14. The method of claim 13, where the first, second, and third entry conduit orifices are identical in shape and size.

15. The method of claim 13, where each of the first, second, and third entry conduit orifices are not identical in shape and size.

16. An oil separator in a positive crankcase ventilation system, comprising: an exit port in fluidic communication with an intake manifold; an oil separation conduit coupled to the exit port via a gas outlet and having an another outlet for separated oil in fluidic communication with an oil drain chamber; and an entry conduit including at least one orifice, the entry conduit and the at least one orifice each having a central axis angled 90 degrees from a central axis of the oil separation conduit, and the at least one orifice opening into the oil separation conduit at a point between the gas outlet and the another outlet for separated oil; where the central axis of the oil separation conduit is angled between 110 and 160 degrees from a vertical axis.

17. The oil separator of claim 16, where a portion of the oil separation conduit is positioned above the entry conduit.

18. The oil separator of claim 16, where the oil separation conduit and the entry conduit orifice are cylindrical.

* * * * *